US006338704B1

(12) United States Patent
Endelman

(10) Patent No.: US 6,338,704 B1
(45) Date of Patent: Jan. 15, 2002

(54) EXERCISE APPARATUS

(75) Inventor: Ken Endelman, Sacramento, CA (US)

(73) Assignee: Balanced Body, Inc., Sacramento, CA (US)

( * ) Notice: Subject to any disclaimer, the term of this patent is extended or adjusted under 35 U.S.C. 154(b) by 0 days.

(21) Appl. No.: 09/663,275

(22) Filed: Sep. 18, 2000

Related U.S. Application Data

(63) Continuation-in-part of application No. 09/176,533, filed on Oct. 21, 1998, now Pat. No. 6,120,425.

(51) Int. Cl.[7] ..... A63B 26/00

(52) U.S. Cl. ..... 482/142; 482/129; 482/133; 482/139; 482/70

(58) Field of Search ..... 482/142, 71–72, 482/101, 121–123, 129–136, 95–96, 91, 54

(56) References Cited

U.S. PATENT DOCUMENTS

| | | | | |
|---|---|---|---|---|
| 339,638 | A | 4/1886 | Goldie | |
| 1,621,477 | A | 3/1927 | Pilates | |
| 1,738,987 | A | 12/1929 | Dattilo | |
| 1,750,549 | A | 3/1930 | Thomson et al. | |
| 1,979,783 | A | 11/1934 | Williams et al. | |
| 1,980,036 | A | 11/1934 | Casler et al. | |
| 2,733,922 | A | 2/1956 | Diego | 272/58 |
| 3,261,606 | A | 7/1966 | Elia et al. | 272/72 |
| 3,586,322 | A | 6/1971 | Kverneland | 272/72 |
| 3,770,267 | A | 11/1973 | McCarthy | 272/58 |
| 3,892,404 | A | 7/1975 | Martucci | 272/79 R |
| 4,084,815 | A | 4/1978 | Flannery | 272/119 |
| 4,272,074 | A | 6/1981 | Sferle | 272/120 |
| 4,383,684 | A | 5/1983 | Schliep | 272/120 |
| 4,700,945 | A | 10/1987 | Rader | 272/127 |
| 4,706,953 | A | 11/1987 | Graham | 272/120 |
| 4,768,776 | A | 9/1988 | Giannotti | 272/72 |
| 4,884,802 | A | * 12/1989 | Graham | 272/136 |
| 4,911,438 | A | 3/1990 | Van Straaten | 272/138 |

(List continued on next page.)

FOREIGN PATENT DOCUMENTS

| | | |
|---|---|---|
| DE | 2944599 | 5/1981 |
| FR | 1470421 | 1/1967 |
| FR | 2625907 | 7/1989 |

OTHER PUBLICATIONS

Stott Equipment Brochure, pp. 1–8.

*Primary Examiner*—Jerome W. Donnelly
*Assistant Examiner*—Lori Baker Amerson
(74) *Attorney, Agent, or Firm*—John R. Wahl; Merchant & Gould PC

(57) ABSTRACT

An exercise apparatus comprises a generally rectangular frame having a head end and a foot end and including a pair of spaced apart parallel track members, a movable carriage mounted on the frame for movement along the track members between said head and foot ends against one or more springs connected between the carriage and the foot end of the frame. The carriage has a generally flat upper surface for supporting a user's body. The upper surfaces has a pair of spaced shoulder stops and ahead rest extending from the carriage toward the head end. The foot end includes an elastic member anchor bar and carriage stop assembly to adjustably position the carriage and elastic members on the tracks to accommodate a wide range of user heights. The foot end also includes a pair of upright foot rest bar support brackets fastened to the frame. Each upright foot rest bar support bracket has a plurality of slanted slots therein operably positioned to receive a central bar portion of a foot rest support bar. Each slot has a protrusion operable to engage the central portion of the foot rest support bar in the slot and frictionally interfere with removal of the foot bar support bar from the slot when the support bar is fully inserted into the slot.

9 Claims, 5 Drawing Sheets

U.S. PATENT DOCUMENTS

| | | | | | |
|---|---|---|---|---|---|
| 4,974,832 | A | | 12/1990 | Dalebout | 272/72 |
| 5,024,214 | A | | 6/1991 | Hayes | 128/75 |
| 5,066,005 | A | | 11/1991 | Luecke | 272/136 |
| 5,263,913 | A | | 11/1993 | Boren | 482/96 |
| 5,338,278 | A | * | 8/1994 | Endelman | 482/142 |
| 5,364,327 | A | | 11/1994 | Graham | 482/122 |
| D354,780 | S | | 1/1995 | Endelman | D21/191 |
| D354,781 | S | | 1/1995 | Endelman | D21/191 |
| D362,700 | S | | 9/1995 | Breibart et al. | D21/195 |
| 5,607,381 | A | * | 3/1997 | Endelman | 482/142 |
| 5,653,670 | A | * | 8/1997 | Endelman | 482/142 |
| 5,681,249 | A | * | 10/1997 | Endelman | 482/142 |
| 5,807,217 | A | | 9/1998 | Endelman | 482/142 |

EXERCISE APPARATUS

CROSS REFERENCE TO RELATED APPLICATIONS

This application is a continuation-in-part of U.S. patent application Ser. No. 09/176,533, filed Oct. 21, 1998, now U.S. Pat. No. 6,120,425, issued Sept. 19, 2000 and is related to U.S. Pat. Nos. 5,681,249, 5,338,278, 5,607,381 and 5,653,670, the disclosures of which are incorporated by reference herein in their entirety.

BACKGROUND OF THE INVENTION

1. Field of the Invention

This invention relates generally to the field of exercise equipment in which a movable carriage is utilized to at least partially support a user's body, commonly referred to as a "reformer", and more particularly to a reformer having either or both adjustable carriage travel and extended carriage travel.

2. Description of the Related Art

Joseph H. Pilates, in U.S. Pat. No. 1,621,477, originally developed the concept of using a wheeled platform carriage connected to a resistance device such as a set of weights in conjunction with a stationary frame to provide a variable resistance against which a user could push with his/her feet or pull with the arms while in a sitting or recumbent position in order to exercise the major muscle groups of the user's trunk, legs and/or arms. Since that time many changes and improvements in the design of such an apparatus were developed by Joseph Pilates, and more recently, have been evolved by his students and others. U.S. Pat. No. 5,066,005 and my patents referred to above are representative of the current state of evolutionary development of these changes that have taken place since 1927.

The current conventional apparatus is commonly referred to as a "reformer" which includes a wheeled platform carriage which rides on a rectangular wooden or metal frame. The carriage is connected to a series of parallel springs or elastic members which are in turn connected to a foot end of the rectangular frame. The carriage rides on parallel rails or tracks mounted to the inside of the longer sides of the rectangular frame. This carriage typically includes a pair of spaced, padded, upright shoulder stops and a head rest at one end to support the shoulders and head of the user when he/she is reclined on the carriage. An adjustable foot bar, foot support, or foot rest against which the user places his/her feet is removably mounted to the foot end of the rectangular frame. A spring support rod is positioned across the foot end between the tracks by a spring support bracket fastened to the frame. The rod typically fits in one of three or four recesses or slots in the support bracket, depending on the size or ability of the user. Alternatively, the spring support rod may be permanently fastened to the frame. The user can then push against the foot rest to move the carriage along the track away from the foot rest against spring tension to exercise the leg and foot muscle groups in accordance with prescribed movement routines. The carriage is prevented from moving close to the foot rest by a stop pin fastened to the top of each track, against which the carriage abuts when the carriage is at rest. The maximum limit of carriage travel is provided by the head rest abutting the end wall of the frame.

U.S. Pat. Nos. 5,338,276, 5,607,381 and 5,681,249 disclose several foot rest arrangements and adjustable head rest assemblies for this type of exercise apparatus. One of the difficulties which the currently available reformers do not optimally address is the capability to optimally adjust the apparatus configuration for those users who are outside the normal range of human frame sizes and flexible abilities. The typical basketball player, for example, is well over 6 feet 6 inches in height. Therefore when such a tall person exercises on a reformer, the carriage may be fully extended toward the head end of the frame before the user has fully extended his legs. The springs may also be overextended at this point in the user's movement, subjecting the user's body to other than optimum resistance during the exercise.

Alternatively, a user may be shorter than the norm such that the distance between the foot rest and the shoulder stops on the carriage is less than optimum when the carriage is at rest on the spring stops along the tracks or rails. Accordingly there is a need for a reformer type of exercise apparatus having an adjustable carriage and spring arrangement to accommodate these extremes in physical body sizes as well as optimally position the carriage with respect to the foot rests for user's within the normal body size range. In addition, there is a need for a reformer type of apparatus which accomodates the range of motion of those individuals who are substantially taller than normal.

SUMMARY OF THE INVENTION

The present invention addresses the above identified limitations in conventional reformer designs. The present invention is an exercise apparatus which comprises a preferably wheeled carriage having a generally flat top surface. The carriage is movably mounted on parallel track members of a generally rectangular frame which has a head end and a foot end. The carriage has a pair of shoulder stops mounted thereto and a head rest between the shoulder stops that extends outward from the carriage toward the head end of the frame. A plurality of elastic members connected between the foot end and the carriage elastically biases the carriage toward the foot end of the frame. A movable spring anchor bar and carriage stop assembly and a foot rest support is provided at the foot end of the rectangular frame to anchor the elastic members and position the carriage appropriately in relation to the anchor bar.

The spring anchor bar and carriage stop assembly comprises a pair of spaced elongated stop members which ride on the track members. A spring anchor bar extends between the stop members. The spring anchor bar is captured by a pair of spring anchor support brackets each having a plurality of bar receiving recesses therein. Each support bracket is fixed to one of the track members. Each end of the spring anchor bar is rigidly fastened to one of the elongated stop members. The spring anchor bar and carriage stop assembly lies on top of and across the tracks at the foot end of the frame. The assembly may also include a latch mechanism, that can be operated with one hand, to removably secure the assembly to the spring anchor support brackets. One end of each of the stop members acts as a carriage stop which properly maintains the minimum distance between the carriage and the anchor bar regardless of which recess in the support bracket carries the anchor bar. This feature permits the carriage to be optimally positioned on the tracks for small and large users.

The head end of the frame supports a pair of upright pulley support arms and also includes a cutout between the support arms specifically sized to permit passage of the head support on the movable carriage. This cutout in the frame permits the carriage to travel against spring tension the full length of the parallel tracks to accommodate those users who are substantially taller than the normal range of users of the exercise apparatus.

The foot end of the frame also has a rotatable foot rest supported by a U shaped foot rest support bar. A pair of foot rest support bar support brackets, each of which has several slots for receiving a central portion of the foot rest bar, is fastened to the foot end of the frame. The bracket has a rib in each of the slots to positively retain the foot rest support bar within the slot in order to maintain desired positioning of the foot rest.

Other objects, features and advantages of the present invention will become apparent from a reading of the following detailed description when taken in conjunction with the accompanying drawing wherein a particular embodiment of the invention is disclosed as an illustrative example.

DETAILED DESCRIPTION OF THE INVENTION

Figure 1:
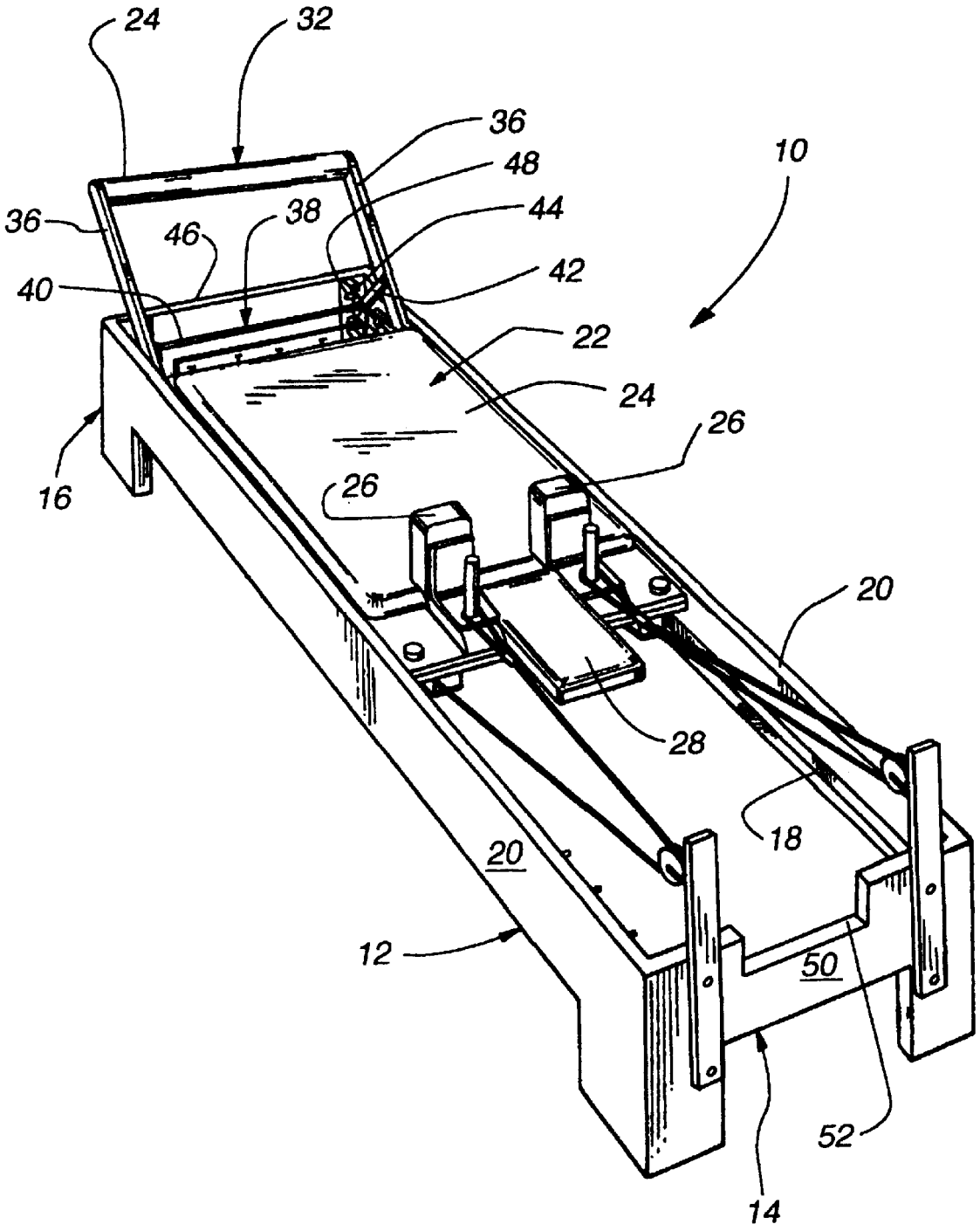
FIG. 1 is a perspective view of the exercise apparatus in accordance with the present invention with the carriage shown in the retracted position against the carriage stop bars.
Figure 2:
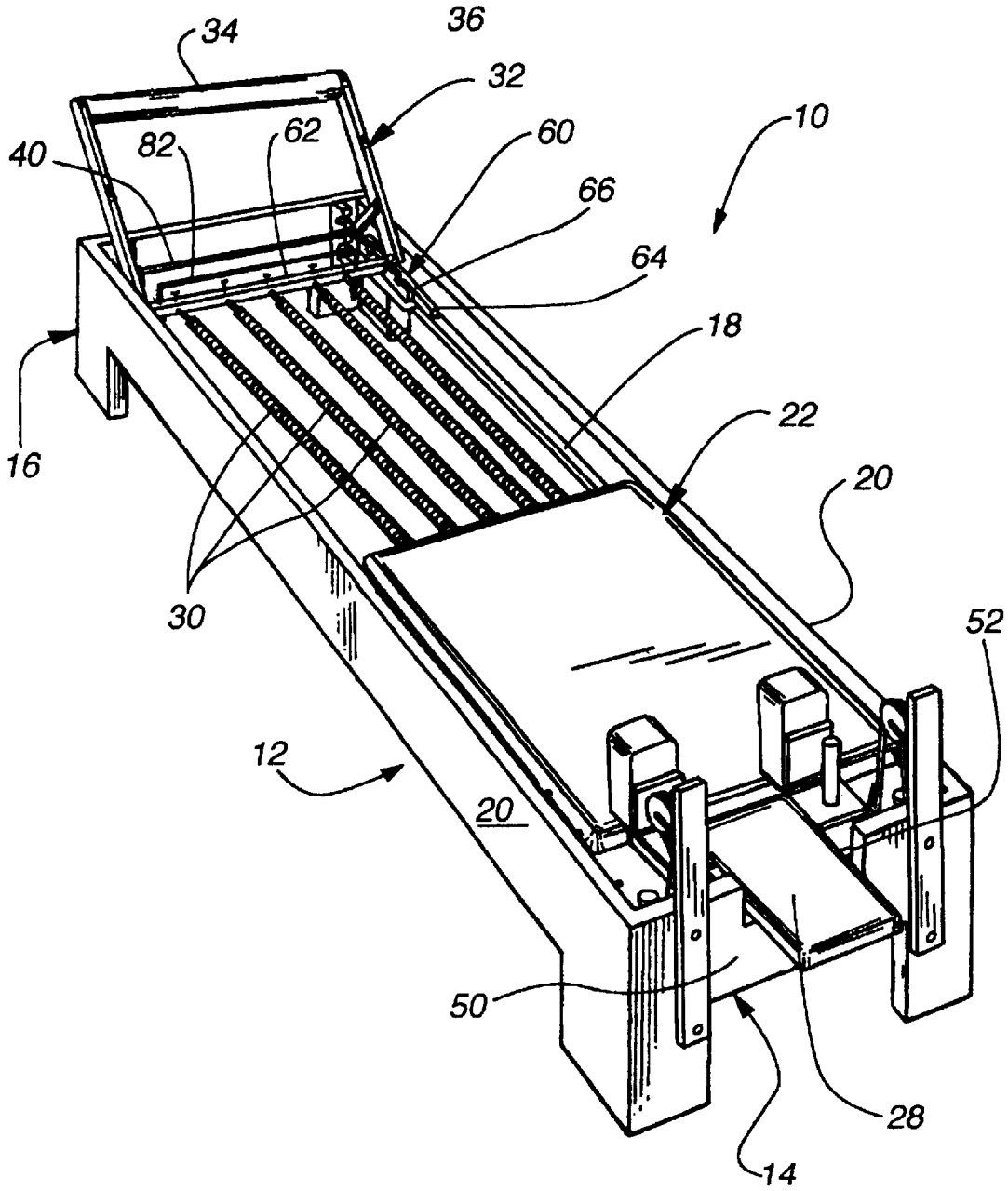
FIG. 2 is a perspective view of the exercise apparatus shown in FIG. 1 with the carriage fully extended to the head end of the frame in accordance with one aspect of the present invention.

An exercise apparatus 10 in accordance with the present invention is shown in a retracted and extended position in FIGS. 1 and 2 respectively. Exercise apparatus 10 comprises a generally rectangular frame 12 having a head end 14 and a foot end 16 and a pair of parallel track or rail members 18. The frame 12 may be a generally rectangular wood frame with the track or rail members 18 fastened to the insides of opposite side walls 20 of the frame 12, or the rail members 18 themselves may constitute the parallel side walls of the frame 12, as in a reformer having a metal tubular frame. The apparatus 10 further comprises a movable carriage 22 slidably or rollably disposed on the track members 18 for movement back and forth on the track members 18 between the head and foot ends 14 and 16 respectively.

The carriage 22 includes a generally flat padded platform 24 for supporting a user's body and has a pair of spaced apart shoulder stops26 fastened to the upper surface of the platform 24 adjacent the head end of the carriage 22 and a head rest 28 centered between the shoulder stops 26. The head rest 28 may be hinged to the platform 24 such that it may be adjusted between at least a raised and a lowered position. The head rest extends outward from the platform 24 toward the head end of the frame 12. Preferably the carriage 22 has four wheels or rollers (not shown) which support the carriage 22 on the track members 18 for movement back and forth on the track members 18 with minimal friction. A plurality of elastic resistance members, typically springs 30 as shown in the Figures, are hooked to or otherwise fastened between the foot end of the carriage 22 and the foot end 14 of the frame 12 such that the carriage 22 is biased toward the foot end of the frame 12.

A U shaped foot rest bar 32 having a central foot rest portion 34 and two support legs 36 is pivotally mounted to the side walls 20 near the foot end 16 of the frame 12. This foot rest bar 32 is supported above the frame 12 by a U shaped bar support 38 which has a straight central bar portion 40 between parallel leg portions 42 which are in turn pivotally attached to the legs 36 of the foot rest bar 32 at a point between the ends of the legs 36. The central portion 40 of the bar support 38 is sized to rest in a pair of foot rest bar support brackets 44. These support brackets 44 are fastened to the end wall 46 of the frame 12 and each of the foot rest bar support brackets 44 has a series of vertically spaced recesses or slots 48 adapted to receive the central portion 40 of the support 38. Since these slots 48 are spaced vertically, the vertical position of the foot rest portion 34 of the foot rest bar 32 may be varied by repositioning the support 38 into a different slot 48.

Referring now specifically to FIG. 2, another aspect of the present invention is shown. The carriage 22 is shown extended, stretching the springs 30, all the way to the head end 14. The head end 14 has an end wall 50 spacing the two side walls 20 apart. This end wall 50 has an aperture or cutout 52 therethrough permitting the head rest 28 to fit therethrough so that the carriage 22 is fully butted up against the inside of the end wall 50. This cutout 52 permits the carriage 22 to travel 3-6 inches further than with the conventional reformer designs discussed above.

One embodiment of another aspect of the present invention is shown at the foot end 16 in FIG. 2. The springs 30 are attached to an anchor bar and carriage stop assembly 60 on the tracks 18 at the foot end 16. The anchor bar and carriage stop assembly 60 adjustably anchors the springs to an anchor bar 62 at the foot end 16 of the frame 12 and maintains a predetermined minimum distance between the carriage 22 and the anchor bar 62. The anchor bar 62 is preferably an elongated straight bar having a rectangular cross section. Each end of the anchor bar 62 is fastened, preferably by a welded joint, to a carriage stop bar 64 which extends at right angles to the anchor bar 62. Each of the carriage stop bars 64 extends parallel to each other and rests on top of the track members 18 as shown in the plan view of FIG. 4.

Figure 3:
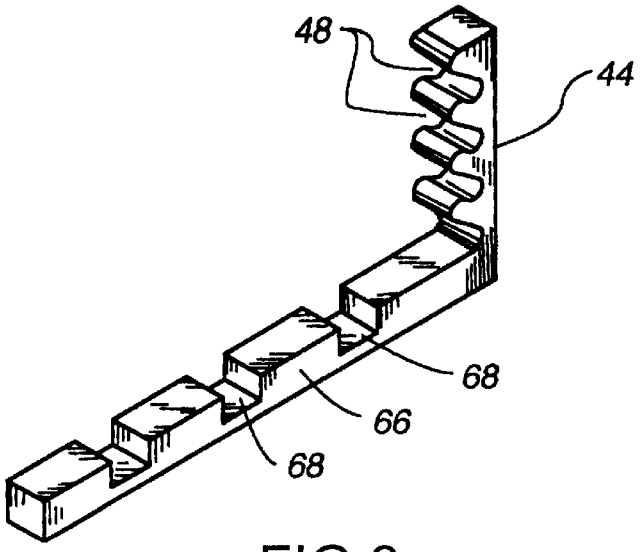
FIG. 3 is a separate perspective view of one embodiment of an integral foot bar and anchor bar support bracket in accordance with another aspect of the present invention.

The anchor bar 62 is captured in anchor bar support brackets 66 which are preferably fixedly attached to the tracks 18. Each of the support brackets 66 has a plurality of rectangular notches 68 therein each of which is sized to receive the anchor bar 62. These brackets 66 may be separate structures as is shown in FIGS. 1 and 2 and FIG. 5. Alternatively, the anchor bar support bracket 66 may be integrally formed with the foot rest support bar support bracket 44 as is separately shown in FIG. 3. In this case the integral bracket would be fastened to both the track 18 and the wall 46 as is shown in FIGS. 4, 5 and 6.

Figure 4:
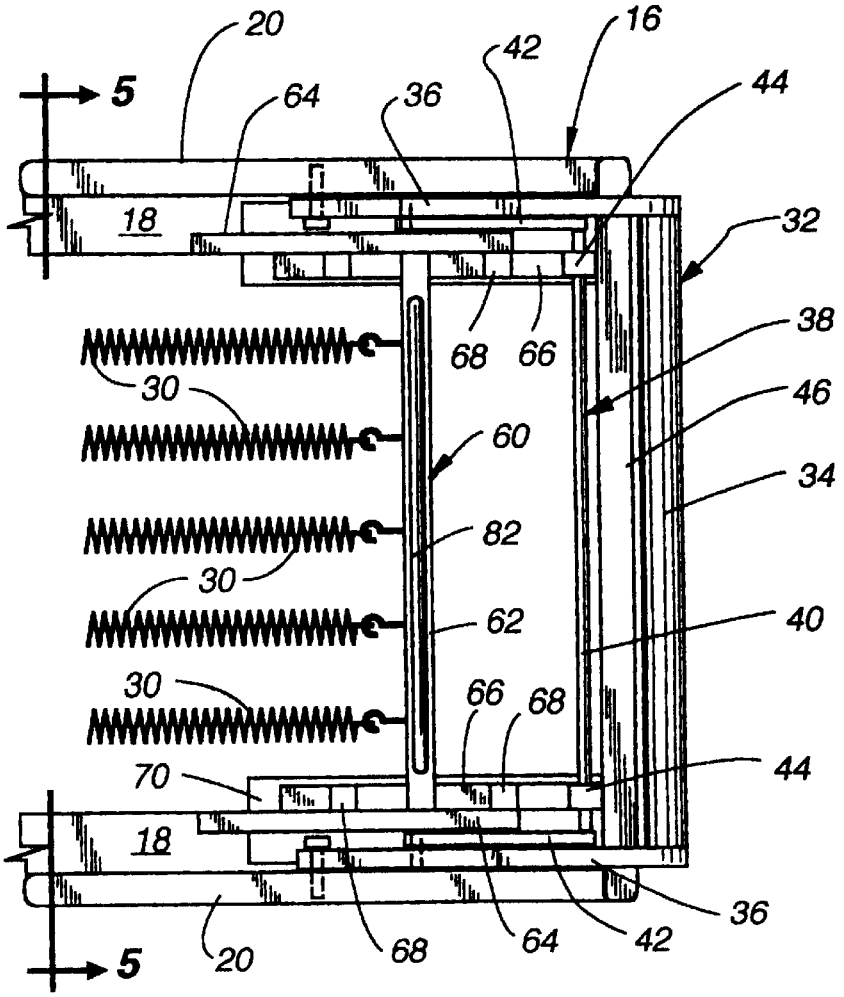
FIG. 4. Is a partial plan view of the foot end of the apparatus according to the present invention with the carriage (not shown) extended against spring tension.
Figure 5:
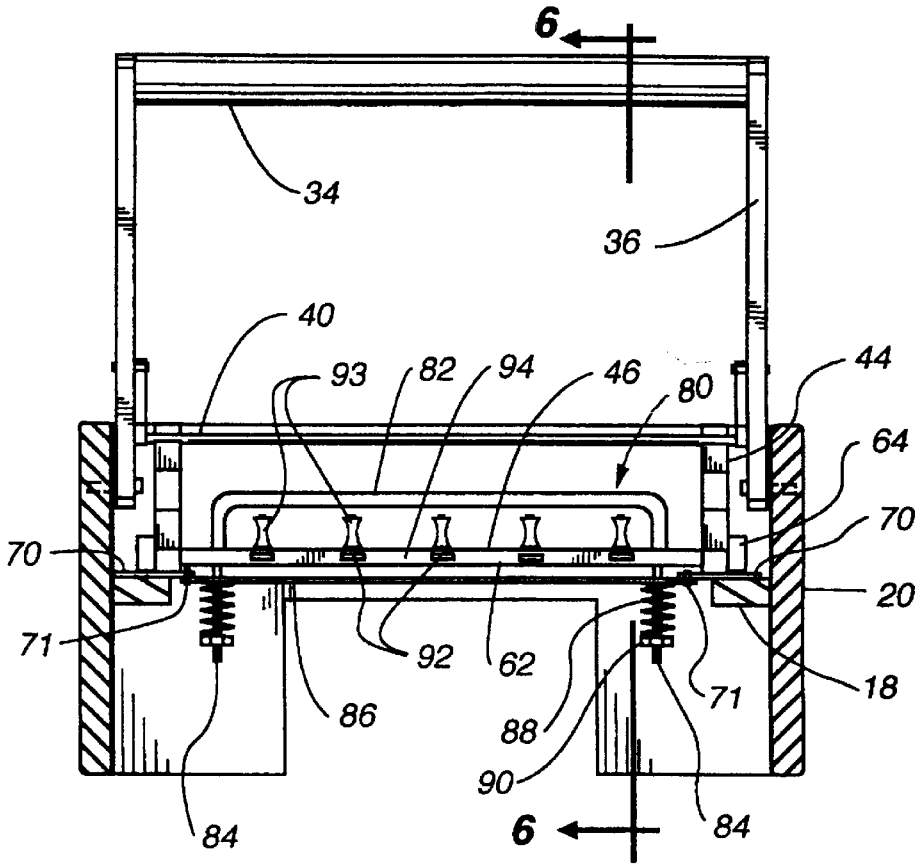
FIG. 5 is a sectional view of the apparatus shown in FIG. 4 taken along the line 5—5.
Figure 6:
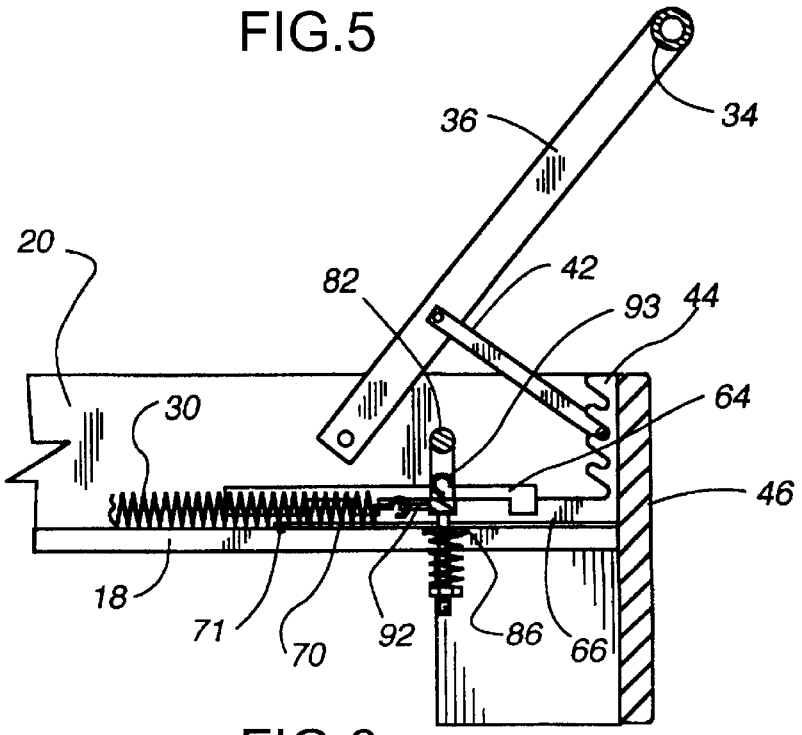
FIG. 6 is a sectional view of the apparatus shown in FIG. 4 taken along the line 6—6 in FIG. 5.

The anchor bar support bracket may also have a base plate 70 fastened to the track 18 and the bracket 66 in turn fastened to the base plate 70 as is shown in FIGS. 4, 5 and 6. Also, as best shown in FIG. 4, the anchor bar 62 is preferably fastened to the rear end of the stop bar 64. However, it may alternatively be fastened to the rear end of the stop bar 64 bar 62 may be positioned in a slot 68 directly beneath the support bracket 44 at the end wall 46.

As is best shown in FIGS. 5 and 6, the assembly 60 also includes a latching mechanism 80 for ensuring positive engagement and retention of the anchor bar 62 in the notches 68 at all times during which a user may be exercising on the apparatus 10. Many configurations of latching mechanisms are possible. One arrangement is shown as being exemplary. The latching mechanism 80 preferably comprises an elongated latch handle 82 which has parallel threaded ends 84 bent at right angles to the handle 82 and extending through vertical apertures through the anchor bar 62 adjacent each end of the anchor bar 62. A latch bar 86 extends between the tracks 18 under the anchor bar 62 and is slidably fastened to the threaded ends 84. The latch bar 86 is long enough so that its ends engage the undersides of the base plates 70. A coil spring 88 is positioned on each of the threaded ends 84 and is captured between the latch bar 86 and a nut 90 threaded onto each of the threaded ends 84. The coil springs 88 bias the latch plate toward the anchor bar 62 and in turn provide a spring bias on the anchor bar 62 into the recesses or notches 68 in the support bracket 66.

The springs 30 each have a ring at the rear end which can be slipped onto one of two different anchors 92 or 93, depending on the spring tension desired on the carriage 22 when the carriage is at rest against the ends of the stop bars 64. The anchor bar 62 has preferably five anchor hooks 92 spaced apart along one side facing the carriage 22. Another series of five preferably spool shaped posts or hook anchors 93 are fastened to the upper side of the anchor bar 62. This arrangement provides an adjustment between a relaxed attachment for the springs, engaging the hooks 92 on the side facing the carriage 22 and affording a small bias when engaging the hook anchors 93 on the upper side. In either configuration, the position of the anchor bar and carriage stop bar, along with the carriage 22 may be changed by simply lifting up the handle 82 and sliding the assemblage to another slot 68. In this way the carriage position relative to the foot rest 32 may be changed independently and without changing the tension on the springs 30. Further, with the anchor arrangement in accordance with the present invention, the anchor bar 62 constrained from any rotation. As can be seen in FIGS. 5 and 6, plates 70 also have a stop 71 projecting from the underside inner corners to prevent a user from inadvertently sliding the anchor bar 62 too far toward the head end 14 and thus disengaging the latch bar 86.

Figure 7:
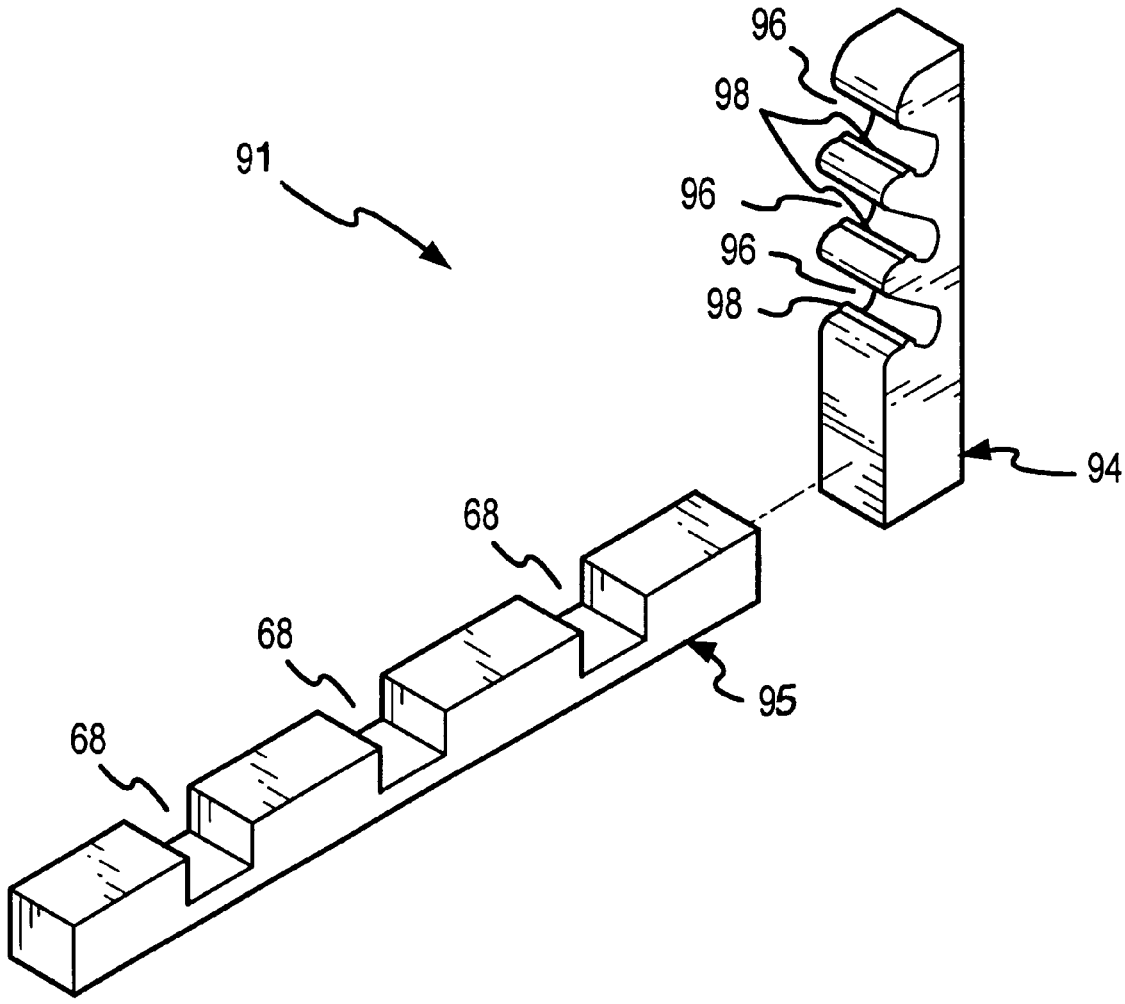
FIG. 7 is a separate perspective view of an alternative foot bar and anchor bar support bracket arrangement in accordance with the present invention.

A perspective view of an alternative of a foot rest and anchor bar support bracket assembly 91 is shown in FIG. 7. The assembly 91 is similar to the foot rest support bar support bracket 44 shown in FIG. 3 except that there are two separate pieces: an anchor bar support bracket 95 and a foot rest support bar support bracket 94. The support bracket 94 is bolted or otherwise fastened to the vertical inside surface of the foot end of the frame 12. The support bracket 95 is bolted or otherwise fastened to the track or rail 18 optionally via a plate 70 as in the embodiment 10 shown in FIGS. 4–6. These brackets 95 and 94 together perform the functions of bracket 44.

The bracket 94 has several open slanted parallel slots 96. The slot 96 is sized to receive the central portion 40 of the U shaped foot rest bar support 38. Each slot 96 has protrusion or transverse rib 98 that interferes with insertion of the central portion 40 of the support 38. The support 38 must be pushed past the rib 98 to fully seat the central portion 40 of the support 38 in each of the slots 96. Conversely, to change the height of the foot rest 32, the central portion 40 must be pulled out of the slots 96 past the ribs 98. This "snap fit" engagement of the central portion 40 in the slots 96 tends to ensure that the foot rest 32 purposefully remains positioned at the desired height during exercises. Each of the separate pieces 95 and 94 is a piece of bar stock preferably manufactured from a plastic material such as a nylon, Delrin or other substantially rigid, tough material. The rib 98 may be a straight transverse rib as shown in FIG. 7 or may be one or more bumps or protrusions on either or both of the upper and lower walls of the slot 96 such that a friction fit must precede full insertion of the central portion 40 of the support 38 into the pair of slots 96. This configuration positively retains the foot support 32 in a desired position. Similarly, the support bracket 44 shown in FIG. 3 may be provided with transverse ribs or protrusions 98 in the slots 48.

The anchor bar support bracket 95 is the same as the long leg of the support 44, having spaced notches 68 to receive the anchor bar 62 as shown in FIG. 4. The anchor bar support bracket 95 may be fastened directly to the rail 18 or fastened first to a plate 70 as shown, depending on the width of the anchor bar 62. The depth of the anchor bar support bracket notches 68 may also be deep enough to accommodate provision of transverse ribs 98 or protrusion to positively retain the anchor bar 62 in the notches 68 in a similar manner as in the slots 96.

The present invention may be practiced otherwise than as specifically described above. Many changes, alternatives, variations, and equivalents to the various structures shown and described will be apparent to one skilled in the art. For example, the anchor bar and carriage stop assembly may be designed for use with a tubular steel apparatus as is disclosed in U.S. Pat. Nos. 5,607,381 and 5,338,278. In this instance, the tracks are tubular frame rails and the carriage stop bars would be shaped to ride on the tubular parallel frame rails. The anchor bar support bracket would similarly be shaped to be attached in a fixed position on the tubular frame rails. The anchor bar 62 and carriage stop bar 64 may have other than rectangular cross sections as shown. These members may be round and may be alternately fashioned from a single piece of material. Similarly, the foot rest 32 and the foot rest support 38 may be made other than as specifically shown and described. The anchors92 may be cap posts, hooks, rings, or other appropriately shaped members designed to receive or attach to one end of each of the springs 30. Alternatively, various other types of elastic resistance elements such as elastic cords may be substituted for springs 30. The carriage 22 may ride in a pair of C shaped channel tracks. Accordingly, the invention may be practiced other than as specifically described and shown herein with reference to the illustrated embodiments. The present invention is not intended to be limited to the particular embodiments illustrated but is intended to cover all such alternatives, modifications, and equivalents as may be included within the spirit and broad scope of the invention as defined by the following claims.

What is claimed is:

1. An exercise apparatus comprising:

a generally rectangular frame having a head end, a foot end and a pair of spaced apart parallel track members therebetween;

a movable carriage mounted on said frame for movement along said track members between said head and foot ends, said carriage having a generally flat upper surface, a pair of spaced shoulder stops mounted to said upper surface and a head rest extending toward said head end from said upper surface of said carriage;

a plurality of elongated elastic members extending between said carriage and said foot end of said frame; and a foot rest assembly mounted to said frame near said foot end having a rotatably supported foot rest bar supported by a U shaped foot rest support bar having leg ends fastened to the foot bar and a central bar portion between the leg ends received in a slot formed in a foot rest support bar support bracket fastened to the foot end of the frame wherein the slot is shaped to operably retain the foot rest support bar in the slot.

2. The apparatus according to claim 1 further comprising:

a movable elastic member anchor bar and carriage stop assembly mounted at said foot end of said frame for adjustably anchoring said plurality of elastic members at different distance positions from said foot end of said frame while maintaining a predetermined minimum distance between said carriage and said anchor bar at each of said positions.

3. The apparatus according to claim 2 wherein said anchor bar and carriage stop assembly comprises a pair of anchor bar support brackets each fastened to one of said track members.

4. The apparatus according to claim 1 further comprising a second support bracket fastened to the foot end of the frame operably receiving and retaining said central portion of said foot rest support bar.

5. The apparatus according to claim 4 wherein each of the slots has a protrusion interfering with free insertion and removal of the central portion of the foot rest support bar so that the central portion is positively retained within the slot.

6. The apparatus according to claim 5 wherein the foot rest support bar support bracket has a plurality of parallel slots for receiving the central portion of the foot rest support bar.

7. The apparatus according to claim 6 wherein each slot has a protrusion operative to interfere with insertion and removal of the central portion of the foot rest suppport bar.

8. In an exercise apparatus having a generally rectangular frame having a head end, a foot end and a pair of spaced apart parallel track members therebetween, a movable carriage mounted on said frame for movement along said track members between said head and foot ends, a plurality of elongated elastic members extending between said carriage and said foot end of said frame, and a movable elastic member anchor bar and carriage stop assembly mounted at said foot end of said frame for adjustably anchoring said plurality of elastic members at different distance positions from said foot end of said frame while maintaining a predetermined minimum distance between said carriage and an anchor bar at each of said positions, a foot rest assembly comprising:

a pair of upright foot rest bar support brackets fastened to the frame each adjacent an anchor support bracket fastened to the frame, each upright foot rest bar support bracket having a plurality of slanted slots therein operably positioned to receive a central bar portion of a foot rest support bar wherein each slot has a protrusion operable to engage the central portion of the foot rest bar support in the slot and frictionally interfere with removal of the foot bar support bar from the slot when the support bar is fully inserted into the slot.

9. The foot rest assembly according to claim 8 wherein the protrusion is an elongated rib in one wall of the slot.

* * * * *